US006948775B2

(12) United States Patent
Tsai

(10) Patent No.: US 6,948,775 B2
(45) Date of Patent: Sep. 27, 2005

(54) OFFICE CHAIR ARMREST

(76) Inventor: Po-Chuan Tsai, P.O. Box 90, Tainan City (TW)

( * ) Notice: Subject to any disclaimer, the term of this patent is extended or adjusted under 35 U.S.C. 154(b) by 56 days.

(21) Appl. No.: 10/785,165

(22) Filed: Feb. 20, 2004

(65) Prior Publication Data

US 2005/0184574 A1 Aug. 25, 2005

(51) Int. Cl.[7] ..... A47C 7/54

(52) U.S. Cl. ..... 297/411.37; 297/411.35; 297/411.38; 297/411.2

(58) Field of Search ..... 297/411.2, 411.38, 297/411.35, 411.37

(56) References Cited

U.S. PATENT DOCUMENTS 5,484,187 A * 1/1996 Doerner et al. ..... 297/411.3
5,641,203 A * 6/1997 Van De Riet et al. .. 297/411.37
5,876,097 A * 3/1999 Cao ..... 297/411.37
5,927,811 A * 7/1999 Tseng ..... 297/353
6,017,091 A * 1/2000 Cao ..... 297/411.37
6,059,366 A * 5/2000 Hu ..... 297/411.35
6,502,904 B1 * 1/2003 Hansen ..... 297/411.35
6,540,300 B2 * 4/2003 Piretti ..... 297/411.35
6,663,182 B1 * 12/2003 Dolci et al. ..... 297/411.35

* cited by examiner

*Primary Examiner*—Laurie K. Cranmer

(57) ABSTRACT

An office chair armrest includes a support rod, a base, a locating seat, a mounting seat and an upper cover, wherein the base has a chamber having at least one guide rail each provided with engagement grooves; the locating seat has a recess having engagement grooves and at least one engagement block for engaging in on of the engagement grooves of the base by means of resilience of a spring; the mounting seat has at least one engagement block for engaging in one of the engagement grooves of the locating seat by means of resilience of a spring, thereby enabling the office chair armrest to be adjusted to move forward, backward, leftward or rightward by a user himself according to his own need to be in a proper position or at a proper angle that is comfortable for his arm to be rested on.

3 Claims, 6 Drawing Sheets

OFFICE CHAIR ARMREST

BACKGROUND OF THE INVENTION

1. Field of the Invention

This invention relates to an office chair armrest, particularly to one including a support rod, a base, a locating seat, a mounting seat and an upper cover, wherein the base has a chamber disposed therein, the chamber having at least one guide rail disposed therein, the at least one guide rail each provided with a plurality of engagement grooves; the locating seat has a recess disposed therein and at least one engagement block protruded at both sides thereof, the recess provided with a plurality of engagement grooves, the at least one engagement block each capable of engaging in one of the engagement grooves of the at least one guide rail of the base by means of resilience of a spring; the mounting seat capable of being assembled in the recess of the locating seat has at least one engagement block protruded at both ends thereof, the at least one engagement block each capable of engaging in one of the engagement grooves of the recess of the locating seat by means of resilience of a spring; whereby the engagement blocks of the locating seat and the mounting seat may engage respectively in the engagement grooves of the base and the locating seat by means of resilience of the springs, thereby enabling the office chair armrest to be adjusted to move forward, backward, leftward or rightward by the user himself according to his own need to be in a proper position or at a proper angle that is comfortable for his arm to be rested on.

2. Description of the Prior Art

Generally speaking, known conventional office chair armrests 10 integrally formed, as shown in FIG. 1, are combined with both sides of an office chair 12 by screw members 11 for arms of a user to be rested on. However, the conventional office chair armrests 10 are assembled with the office chair 12 in such a stationary way that the user is unable to move them forward or backward to be in proper positions, or rotate them leftward or rightward to be at proper angles according to his own need.

SUMMARY OF THE INVENTION

The main purpose of the invention is to offer an office chair armrest adapted to be adjusted to move forward, backward, leftward or rightward by a user himself according to his own need to be in a proper position or at a proper angle that is comfortable for his arm to be rested on.

The main feature of the invention is to provide an office chair armrest mainly including:

a support rod capable of being combined with one side of an office chair and having a fixed seat disposed at an upper end thereof and a positioning plate mounted in the fixed seat, the positioning plate having a protrusion disposed thereon and a slide block disposed at an upper end of the protrusion and provided with a threaded hole;

a base capable of being assembled on the fixed seat of the support rod and having a chamber disposed therein, the chamber having at least one guide rail disposed therein and an elongated slot formed therein and extending through a bottom thereof, the at least one guide rail each provided with a plurality of engagement grooves;

a locating seat capable of being assembled in the chamber of the base and having a recess disposed therein and at least one recessed groove disposed on a bottom surface thereof, the recess having a plurality of engagement grooves disposed on a wall surface thereof and an axle hole formed therein, the at least one recessed groove each having at least one depression disposed therein and a fixing plate affixed thereto, the at least one depression each having a spring, a retaining block and an engagement block orderly fitted therein;

a mounting seat capable of being assembled in the recess of the locating seat and having an axle journal disposed at a bottom surface thereof, a through hole formed therein and at least one recessed groove disposed on the bottom surface thereof, the through hole extending through the axle journal and capable of being passed through by a screw member, the at least one recessed groove each having a depression disposed therein and a fixing plate affixed thereto, the depression having a spring, a retaining block and an engagement block orderly fitted therein; and, an upper cover capable of being assembled on the base.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
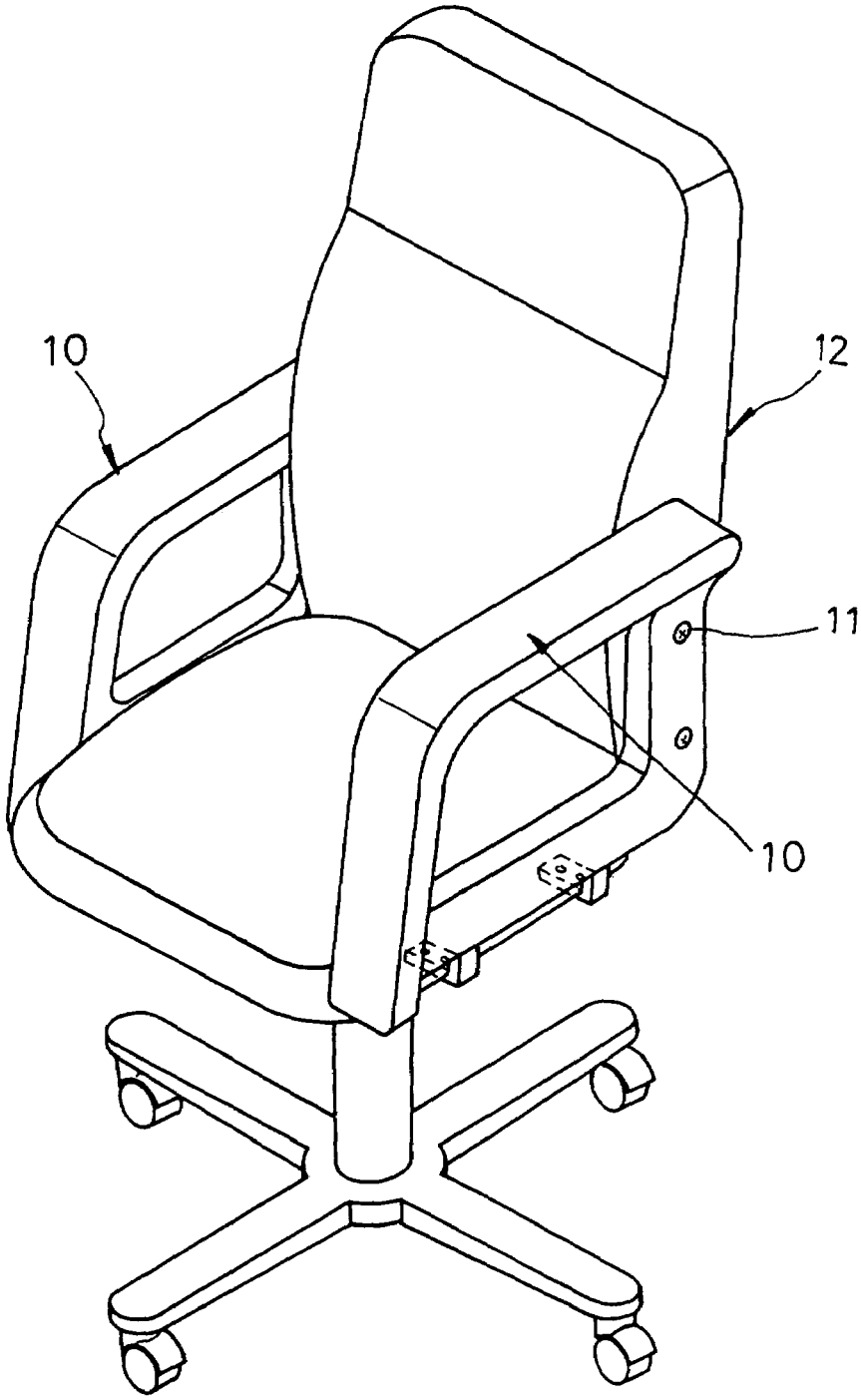
FIG.1 (PRIOR ART)
FIG. 1 is a perspective view of an office chair and known conventional armrests.
Figure 2:
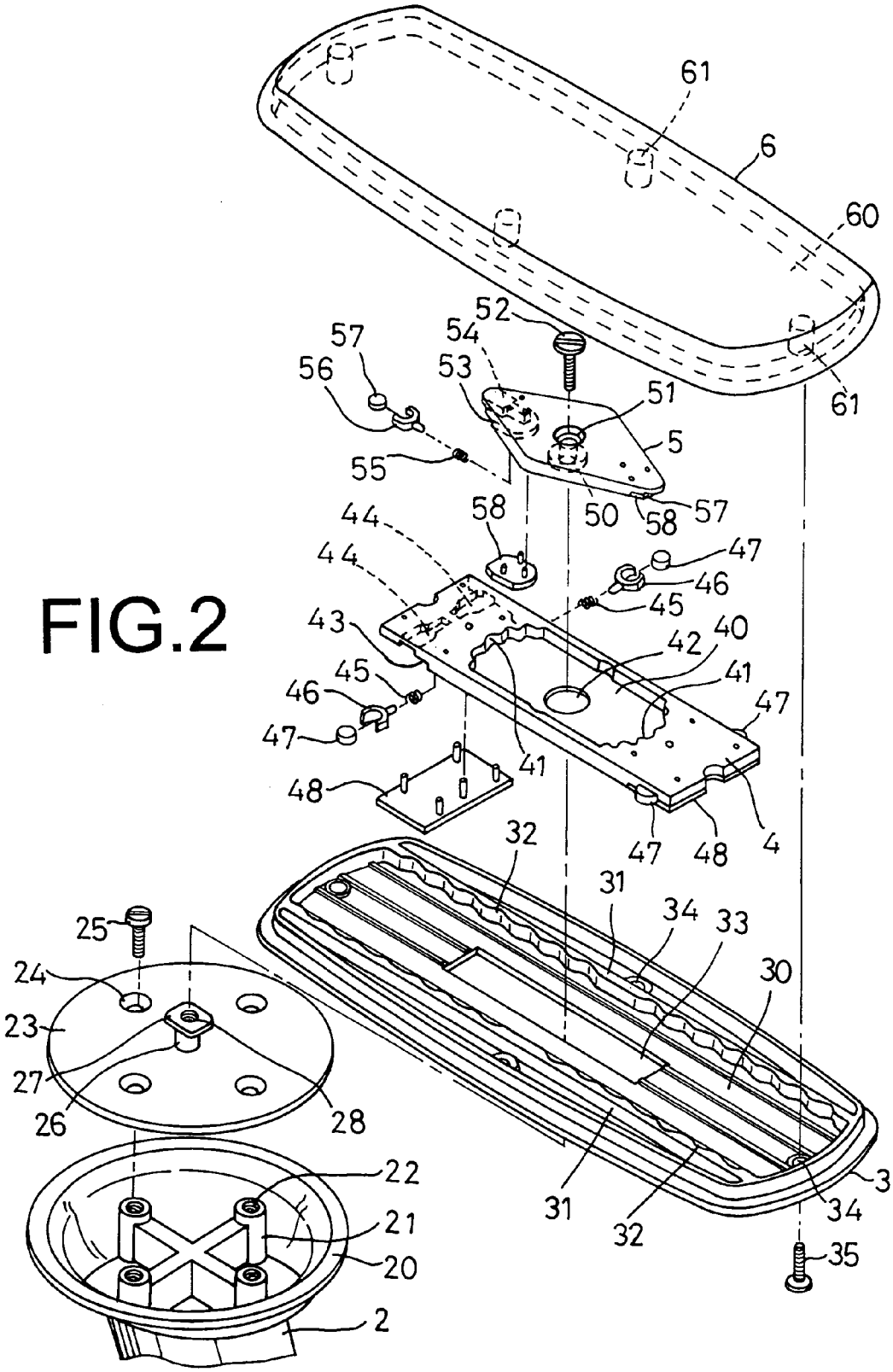
FIG. 2 is an exploded perspective view of an office chair armrest in the present invention.

A preferred embodiment of office chair armrest in the present invention, as shown in FIG. 2, mainly includes a support rod 2, a base 3, a locating seat 4, a mounting seat 5 and an upper cover 6.

The support rod 2 capable of being combined with one side of an office chair has a fixed seat 20 disposed at an upper end thereof and a positioning plate 23 mounted in the fixed seat 20. The fixed seat 20 has a plurality of stubs 21 disposed therein and each of the stubs 21 is provided with a threaded hole 22. The positioning plate 23 has a plurality of through holes 24 capable of being aligned to the stubs 21 of the fixed seat 20 and each of the through holes 24 can be passed through by a screw member 25 to make the positioning plate 23 securely screwed with the stubs 21 of the fixed seat 20. The positioning plate 23 further has a protrusion 26 disposed thereon and a rectangular slide block 27 disposed at an upper end of the protrusion 26 and provided with a threaded hole 28.

The base 3 capable of being assembled on the fixed seat 20 of the support rod 2 has a chamber 30 disposed therein and a plurality of through holes 34 for being passed through by screw members 35. The chamber 30 has two guide rails 31 respectively disposed adjacent both sides thereof and an elongated slot 33 formed therein and extending through a bottom thereof. The two guide rails 31 have an inner surface disposed opposite to each other and provided with a plurality of engagement grooves 32.

The locating seat 4 capable of being assembled in the chamber 30 of the base 3 has a recess 40 disposed therein and two recessed grooves 43 respectively disposed at both sides of a bottom surface thereof. The recess 40 has a pair of plurality of engagement grooves 41 respectively disposed at both ends of a wall surface thereof in positions opposite to each other and an axle hole 42 formed therein. Each of the two recessed grooves 43 has two opposite depressions 44 disposed therein and a fixing plate 48 affixed thereto. Each of the two depressions 44 has a spring 45, a retaining block 46 and an engagement block 47 orderly fitted therein.

The mounting seat 5 capable of being assembled in the recess 40 of the locating seat 4 has an axle journal 50 disposed at a bottom surface thereof, a through hole 51 formed therein and two recessed grooves 53 respectively disposed at both ends of the bottom surface thereof. The through hole 51 extends through the axle journal 50 and may be passed through by a screw member 52. Each of the two recessed grooves 53 has a depression 54 disposed therein and a fixing plate 58 affixed thereto. Each of the depression 54 has a spring 55, a retaining block 56 and an engagement block 57 orderly fitted therein.

The upper cover 6 capable of being assembled on the base 3 has a recess 60 disposed in an interior thereof. The recess 60 has a plurality of stubs 61 disposed therein and aligned to the through holes 34 of the base 3.

Figure 3:
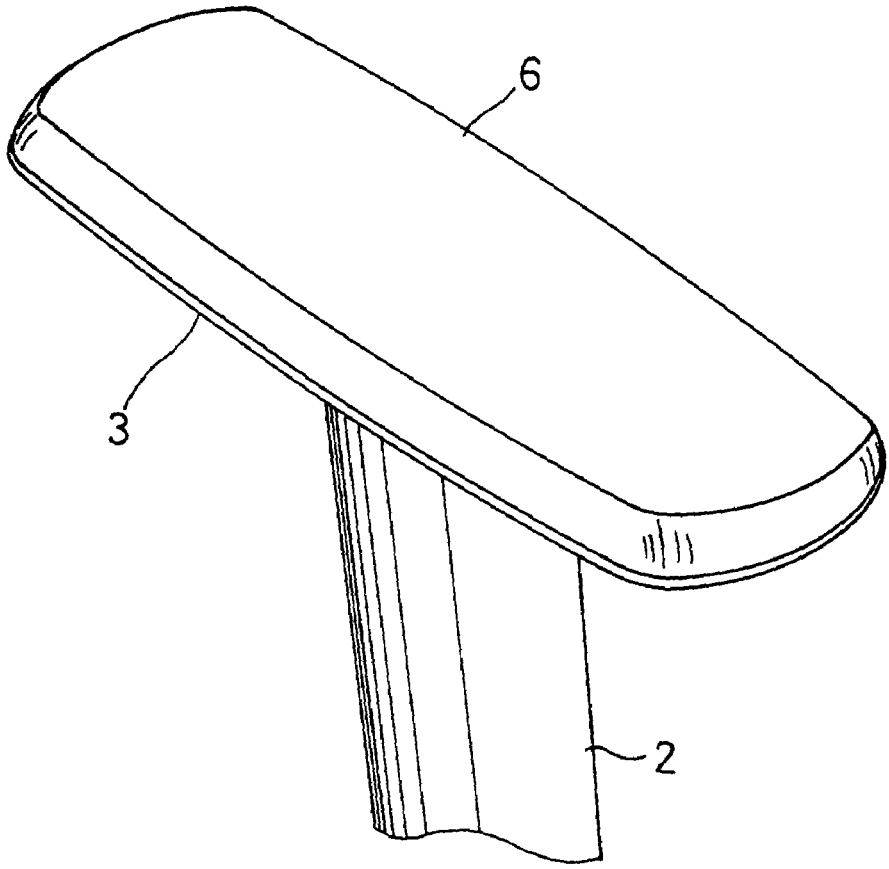
FIG. 3 is a perspective view showing an assemblage of the office chair armrest in the present invention.
Figure 4:
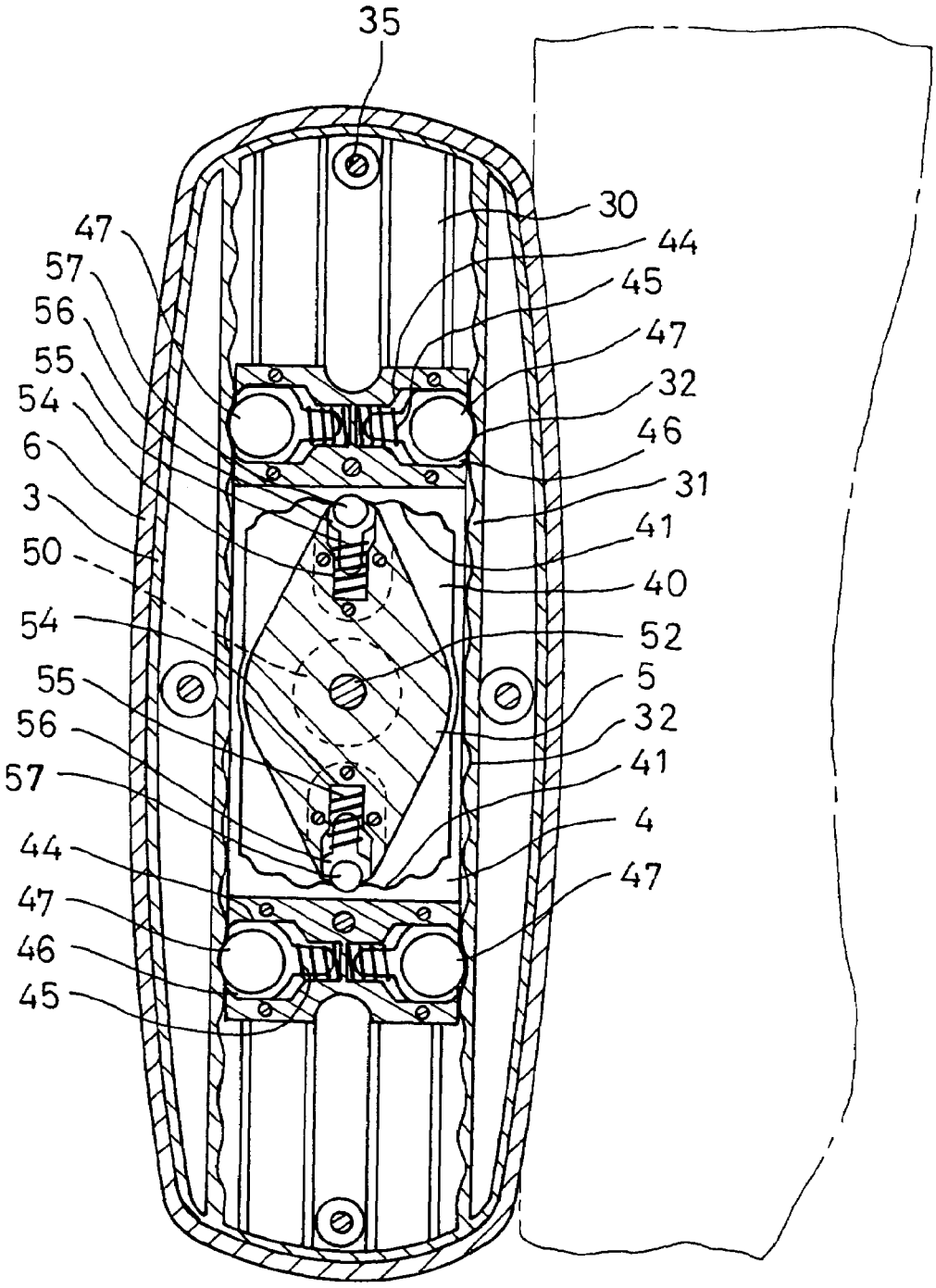
FIG. 4 is a sectional view showing an assemblage of the office chair armrest in the present invention.

In assembling, referring to FIGS. 2, 3 and 4, firstly mount the positioning plate 23 in the fixed seat 20 of the support rod 2 securely by the screw members 25.

Secondly, fit the springs 45, the retaining blocks 46 and the engagement blocks 47 orderly into the depressions 44 of the locating seat 4 with the engagement blocks 47 protruded out of the depressions 44 of the locating seat 4, and then fix the fixing plates 48 respectively onto the recessed grooves 43 to make the springs 45, the retaining blocks 46 and the engagement blocks 47 limited in the depressions 44 of the locating seat 4.

Thirdly, fit the springs 55, the retaining blocks 56 and the engagement blocks 57 orderly into the depressions 54 of the mounting seat 5 with the engagement blocks 57 protruded out of the depressions 54 of the mounting seat 5, and then fix the fixing plates 58 respectively onto the recessed grooves 53 to make the springs 55, the retaining blocks 56 and the engagement blocks 57 limited in the depressions 54 of the mounting seat 5.

Fourthly, assemble the locating seat 4 in the chamber 30 of the base 3 with the engagement blocks 47 that are protruded at both sides of the locating seat 4 engaging in the engagement grooves 32 of the guide rails 31 of the base 3.

Fifthly, assemble the mounting seat 5 in the recess 40 of the locating seat 4 with the engagement blocks 57 that are protruded at both ends of the mounting seat 5 engaging in the engagement grooves 41 of the recess 40 of the locating seat 4.

Sixthly, place the base 3 on the fixed seat 20 of the support rod 2 with the rectangular slide block 27 of the positioning plate 23 of the fixed seat 20 protruded upwards in the elongated slot 33.

Seventhly, pass the axle journal 50 of the mounting seat 5 though the axle hole 42 of the recess 40 of the locating seat 4 to make the through hole 51 of the mounting seat 5 aligned to the threaded hole 28 of the rectangular slide block 27, and then insert the screw member 52 into the through hole 51 of the mounting seat 5 to make the screw member 52 screwed with the rectangular slide block 27.

Finally, assemble the upper cover 6 on the base 3 by having the screw members 35 passed through the through holes 34 of the base 3 and screwed with the stubs 61 of the upper cover 6, by which an assemblage of the whole structure of the office chair armrest in the present invention is completed.

Figure 5:
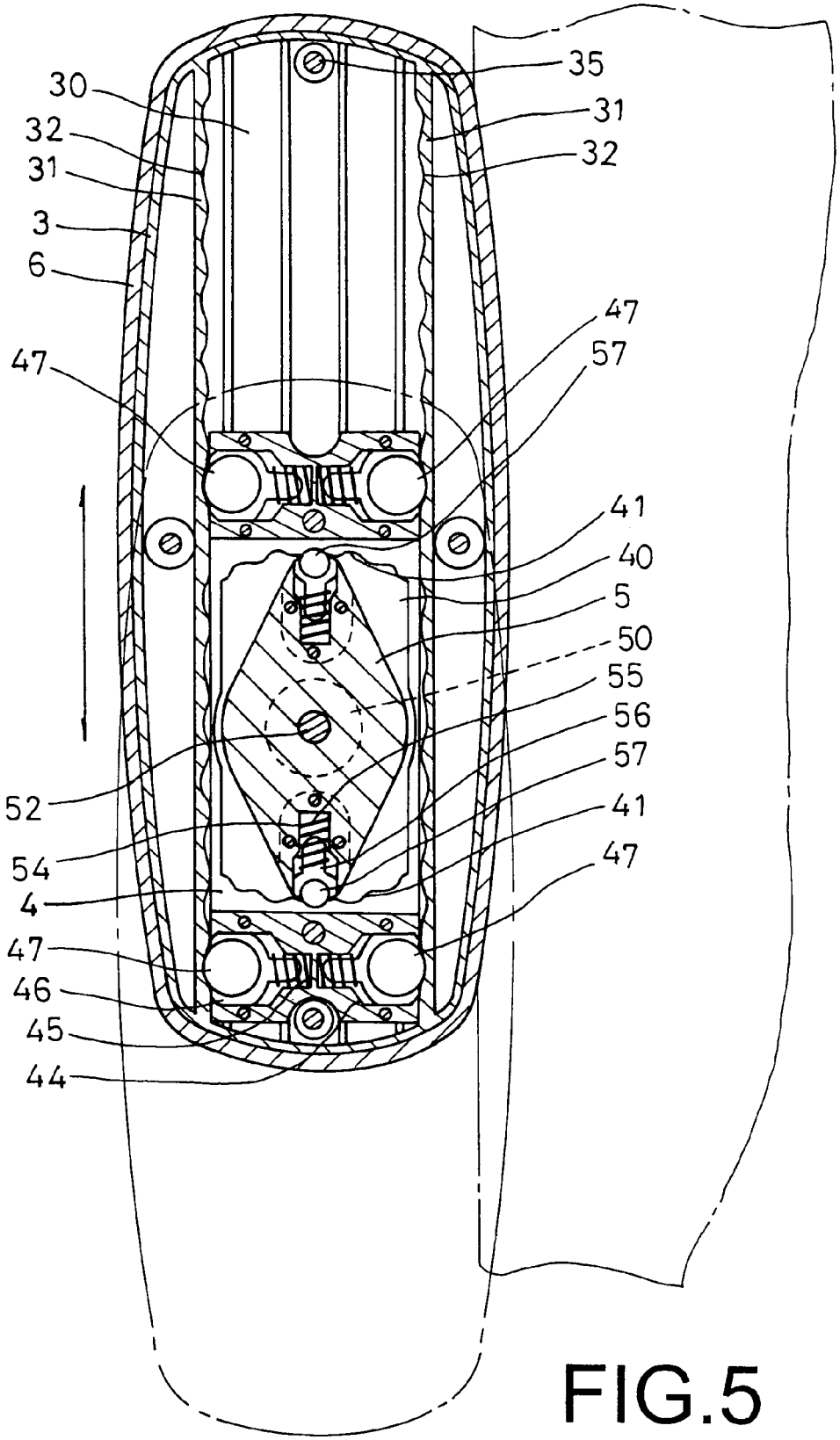
FIG. 5 is a schematic view illustrating the office chair armrest in the present invention capable of being adjusted to move forward and backward; and, FIG. 6 is a schematic view illustrating the office chair armrest in the present invention capable of being adjusted to move leftward and rightward.

When the office chair armrest of the present invention is to be adjusted forwards or backwards, referring to FIG. 5, it is only necessary to force the office chair armrest to move forward or backward with the base 3 and the upper cover 6 moved together, by which the engagement blocks 47 that are protruded at both sides of the locating seat 4 and engage in ones of the two pluralities of engagement grooves 32 of the guide rails 31 of the base 3 are forced to be shrunk into the depressions 44 of the locating seat 4 by the pressing of the guide rails 31 of the base 3 to make the springs 45 that are also disposed in the depressions 44 to be in a compressed status until the engagement blocks 47 are respectively forced to slide into and urged to engage in any required ones of the two pluralities of engagement grooves 32 firmly in position under the resilience of the springs 45, thus the adjustment of the office chair armrest in the present invention to move forward or backward can be achieved easily.

Figure 6:
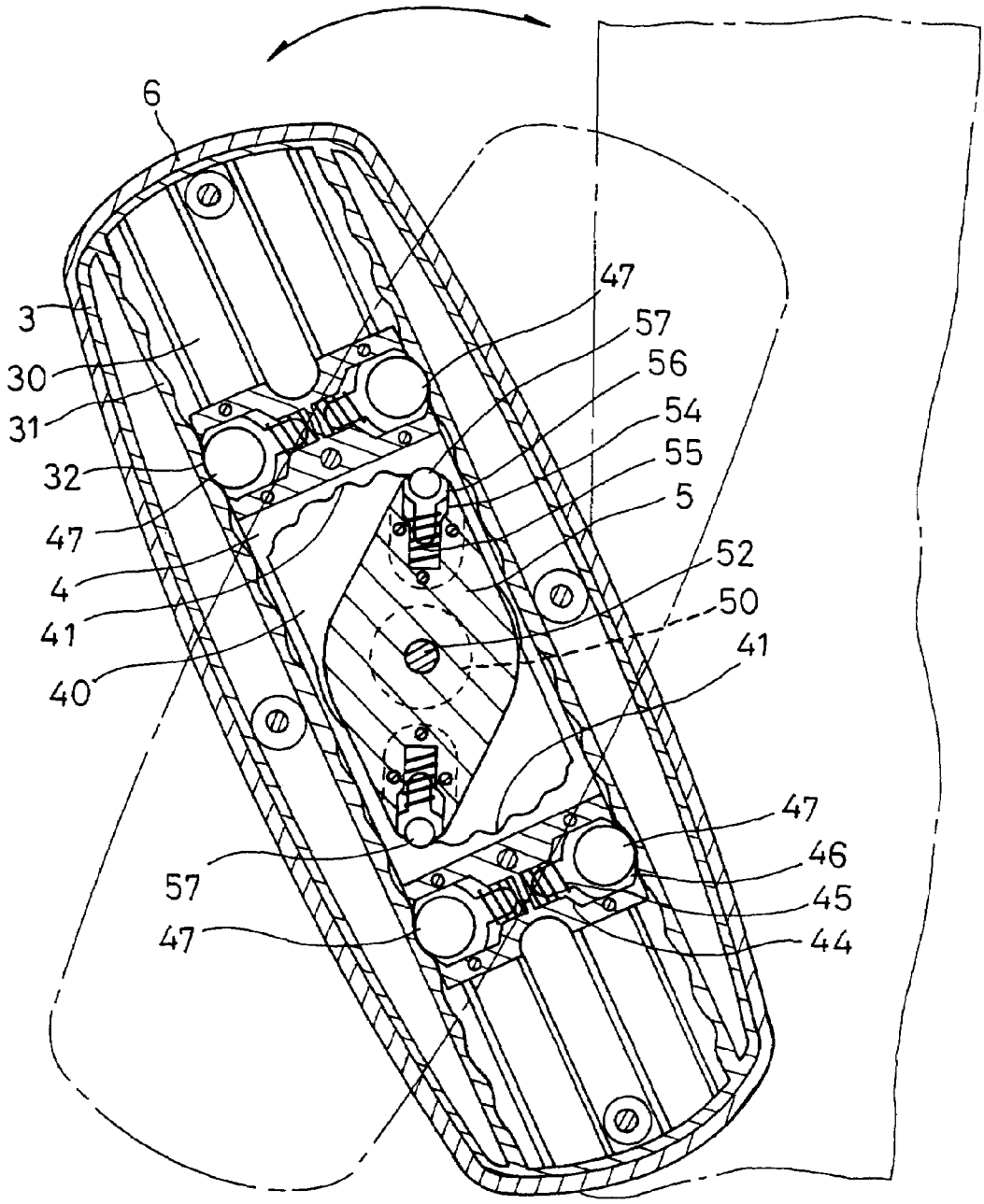

When the office chair armrest of the present invention is to be adjusted leftwards or rightwards, referring to FIG. 6, it is only necessary to force the office chair armrest to rotate leftward or rightward with the base 3 and the upper cover 6 moved together, by which the engagement blocks 57 that are protruded at both ends of the mounting seat 5 and engage in ones of the engagement grooves 41 of the recess 40 of the locating seat 4 are forced to be shrunk into the depressions 54 of the mounting seat 5 by the pressing of the wall surface of the recess 40 of the locating seat 4 to make the springs 55 that are also disposed in the depressions 54 to be in a compressed status until the engagement blocks 57 are respectively forced to slide into and urged to engage in any required ones of the two pluralities of engagement grooves 41 firmly in position under the resilience of the springs 55, thus the adjustment of the office chair armrest in the present invention to rotate leftward or rightward can be achieved easily.

Therefore, the office chair armrest can be adjusted to move forward, backward, leftward or rightward by a user himself according to his need to be in a proper position or at a proper angle that is comfortable for his arm to be rested on.

While the preferred embodiment of the invention has been described above, it will be recognized and understood that various modifications may be made therein and the appended claims are intended to cover all such modifications that may fall within the spirit and scope of the invention.

What is claimed is:

1. An office chair armrest comprising:

a support rod capable of being combined with one side of an office chair and having a fixed seat disposed at an upper end thereof and a positioning plate mounted in said fixed seat, said positioning plate having a protrusion disposed thereon and a slide block disposed at an upper end of said protrusion and provided with a threaded hole;

a base capable of being assembled on said fixed seat of said support rod and having a chamber disposed therein, said chamber having at least one guide rail disposed therein and an elongated slot formed therein and extending through a bottom thereof, said at least one guide rail each provided with a plurality of engagement grooves;

a locating seat capable of being assembled in said chamber of said base and having a recess disposed therein and at least one recessed groove disposed on a bottom surface thereof, said recess having a plurality of engagement grooves disposed on a wall surface thereof and an axle hole formed therein, said at least one recessed groove each having at least one depression disposed therein and a fixing plate affixed thereto, said at least one depression each having a spring, a retaining block and an engagement block orderly fitted therein;

a mounting seat capable of being assembled in said recess of said locating seat and having an axle journal disposed at a bottom surface thereof, a through hole formed therein and at least one recessed groove disposed on said bottom surface thereof, said through hole extending through said axle journal and capable of being passed through by a screw member, said at least one recessed groove each having a depression disposed therein and a fixing plate affixed thereto, said depression having a spring, a retaining block and an engagement block orderly fitted therein; and, an upper cover capable of being assembled on said base.

2. The office chair armrest as claimed in claim 1, wherein said fixed seat of said support rod has a plurality of stubs disposed therein and each of said stubs is provided with a threaded hole;

wherein said positioning plate has a plurality of through holes capable of being aligned to said stubs of said fixed seat; and, whereby each of said through holes of said positioning plate can be passed through by a screw member to make said positioning plate securely screwed with said stubs of said fixed seat.

3. The office chair armrest as claimed in claim 1, wherein said base has a plurality of through holes;

wherein said upper cover has a recess disposed in an interior thereof, and said recess has a plurality of stubs disposed therein and capable of being aligned to said through holes of said base; and, whereby said upper cover and said base can be screwed together by screw members.

* * * * *